US006595033B1

(12) United States Patent
Hara et al.

(10) Patent No.: US 6,595,033 B1
(45) Date of Patent: Jul. 22, 2003

(54) ATTACHMENT STRUCTURE FOR KEY CYLINDER

(75) Inventors: Ikuo Hara, Saitama (JP); Ken Kojika, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/388,525

(22) Filed: Sep. 2, 1999

(30) Foreign Application Priority Data

Sep. 2, 1998 (JP) ..... 10-248839

(51) Int. Cl.[7] ..... E05B 9/04
(52) U.S. Cl. ..... 70/370; 70/373; 70/451
(58) Field of Search ..... 70/370–375, 451, 70/466

(56) References Cited

U.S. PATENT DOCUMENTS

| | | | | |
|---|---|---|---|---|
| 1,561,254 A | | 11/1925 | Ledin | |
| 2,948,141 A | * | 8/1960 | Vahlstrom | 70/370 |
| 3,503,233 A | * | 3/1970 | Russell et al. | 70/370 |
| 4,139,998 A | | 2/1979 | Jeavons et al. | 70/370 |
| 4,586,354 A | * | 5/1986 | Smith | 70/370 X |
| 4,873,852 A | * | 10/1989 | Neyret | 70/370 X |
| 4,910,982 A | * | 3/1990 | Dana | 70/370 |
| 5,251,467 A | * | 10/1993 | Anderson | 70/370 |
| 5,297,405 A | * | 3/1994 | Manning et al. | 70/370 X |
| 5,410,899 A | * | 5/1995 | McConnell | 70/370 |
| 5,435,159 A | * | 7/1995 | Ramsauer | 70/370 |
| 5,457,975 A | * | 10/1995 | Berger et al. | 70/370 |
| 5,548,981 A | * | 8/1996 | Kirk | 70/370 X |
| 5,606,883 A | * | 3/1997 | Svec | 70/370 |
| 5,636,540 A | * | 6/1997 | Myers | 70/370 |
| 5,730,011 A | * | 3/1998 | Terai | 70/370 X |
| 5,915,725 A | * | 6/1999 | Cuddihy et al. | 70/375 X |

FOREIGN PATENT DOCUMENTS

| | | |
|---|---|---|
| DE | 8911765.4 | 3/1989 |
| EP | 258491 A1 | 11/1986 |
| JP | 2539986 | 4/1997 |

* cited by examiner

*Primary Examiner*—Suzanne Dino Barrett
(74) *Attorney, Agent, or Firm*—Birch, Stewart, Kolasch & Birch, LLP

(57) ABSTRACT

A leaf spring includes a plate having a hole into which a key cylinder is inserted, a notch into which a convex portion of the key cylinder is inserted, and spring tabs which can be bent elastically in the insertion direction of the key cylinder formed thereon. The top end of the spring tabs is inclined with respect to the bottom of the rectangular groove before bending, so that the top end is partially brought into contact with the back wall edge after bending. The key cylinder can be attached simply by inserting the key cylinder into the hole of an attachment unit. Freedom of the assembly order is therefore increased. Furthermore, the vibration of the key cylinder in the insertion direction of the key cylinder is reduced.

3 Claims, 8 Drawing Sheets

ATTACHMENT STRUCTURE FOR KEY CYLINDER

BACKGROUND OF THE INVENTION

1. Field of the Invention

This invention relates to improvement of an attachment structure for a key cylinder.

2. Description of Related Art

For example, in FIG. 5 of Japanese Registered Utility Model Publication No. 2539986 entitled "Articles Container Device for Motorcycles," holder 48, leaf spring 49, cover 50, and key cylinder 51 are described. Particularly, the leaf spring 49 is a member which is fitted after the key cylinder is inserted into the cover 50 to prevent the key cylinder 51 from coming off.

An example of a leaf spring similar to the leaf spring 49 for fixing a key cylinder will now be described with reference to FIGS. 10(*a*) and 10(*b*). FIGS. 10(*a*) and 10(*b*) are diagrams for describing a conventional attachment structure of a key cylinder. FIG. 10(*a*) is a side view and FIG. 10(*b*) is a cross sectional view along the line 10—10 in FIG. 10(*a*).

FIG. 10(*a*) shows the structure in which an attachment hole 101 is provided on a rear fender 100. A key cylinder 102 which is for lock release to detach a seat (not shown in the drawing) is inserted into the attachment hole 101. A leaf spring 104 is hooked to a rectangular groove 103 provided on the key cylinder 102 from the inside of the rear fender 100 to thereby prevent the key cylinder 102 from coming out of the attachment hole 101. Reference numeral 105 denotes a tail lamp. An attachment 105*a* for attaching the tail lamp 105 to the rear fender 100 is covered by the seat.

In FIG. 10(*b*), the leaf spring 104 is shaped in the form of a fork, and inside ends of two spring tabs 106, 106 are inserted into the rectangular groove 103 of the key cylinder 102 along the direction of the arrow A.

However, in the FIG. 10(*b*), remarkable skill is required to insert a leaf spring 104 along the arrow A because the tail lamp 105 interferes with the insertion of the leaf spring, since there is insufficient working room. Accordingly, this condition results in high cost.

In addition, if the tail lamp 105 is attached after the leaf spring 104 is inserted, the assembly order is limited. The tail lamp 105 must be detached when the key cylinder 102 is attached.

Furthermore, when the key cylinder 102 is detached for maintenance, the seat must be detached and the tail lamp 105 must be detached by unscrewing a nut of the attachment 105*a*. Therefore, the cost of maintenance is undesirably high.

If the insertion direction of the leaf spring 104 is changed to the direction of the arrow B or arrow C in FIG. 10(*b*) to solve the problem, although the leaf spring 104 can be inserted easily, this structure in which the key cylinder 102 can be detached as the seat remains attached is not preferable when considering theft.

SUMMARY OF THE INVENTION

It is the object of the present invention to provide an attachment structure for a key cylinder which is easily attached and allows the assembly order to be flexible.

To achieve the above object, the present invention includes an attachment structure for a key cylinder provided with a convex portion for preventing rotation on the peripheral surface and a rectangular groove for fixing the key cylinder. The key cylinder is inserted into a hole of an attachment unit of a body and a leaf spring is hooked on the rectangular groove to prevent the key cylinder from coming out of the hole. The leaf spring is a plate having a hole into which a key cylinder is inserted, a notch into which the convex portion is inserted, and spring tabs which can be bent elastically in the insertion direction of the key cylinder formed thereon. The top end of the spring tabs is inclined with respect to the bottom of the rectangular groove before bending so that the top end is partially brought into contact with an edge of the back wall after bending.

The key cylinder can be attached easily to the body simply by inserting the key cylinder into the hole of the attachment unit. Furthermore, the leaf spring is provided previously to the hole of the attachment unit. Accordingly, when other parts are attached around the hole of the attachment unit, the key cylinder can be attached without interference, and freedom of assembly order is increased.

The top end of the spring tab is inclined with respect to the bottom face of the rectangular groove before bending so that the top end of the spring tab is partially in contact with the back wall edge after bending. The insertion depth of the top end of the spring tab can be reduced.

As a result of this action, when the key cylinder is inserted into the hole of the leaf spring, the positional change of the top end from the position before insertion of the top end of the spring tab into the rectangular groove to the position after insertion is reduced. Furthermore, the vibration in the insertion direction of the key cylinder is reduced.

Furthermore, since the position of the top end of the spring tab in the insertion direction of the key cylinder is not changed even if the leaf spring is permanently set with time, the vibration in the insertion direction does not increase. Therefore the vibration in the insertion direction of the key cylinder is reduced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
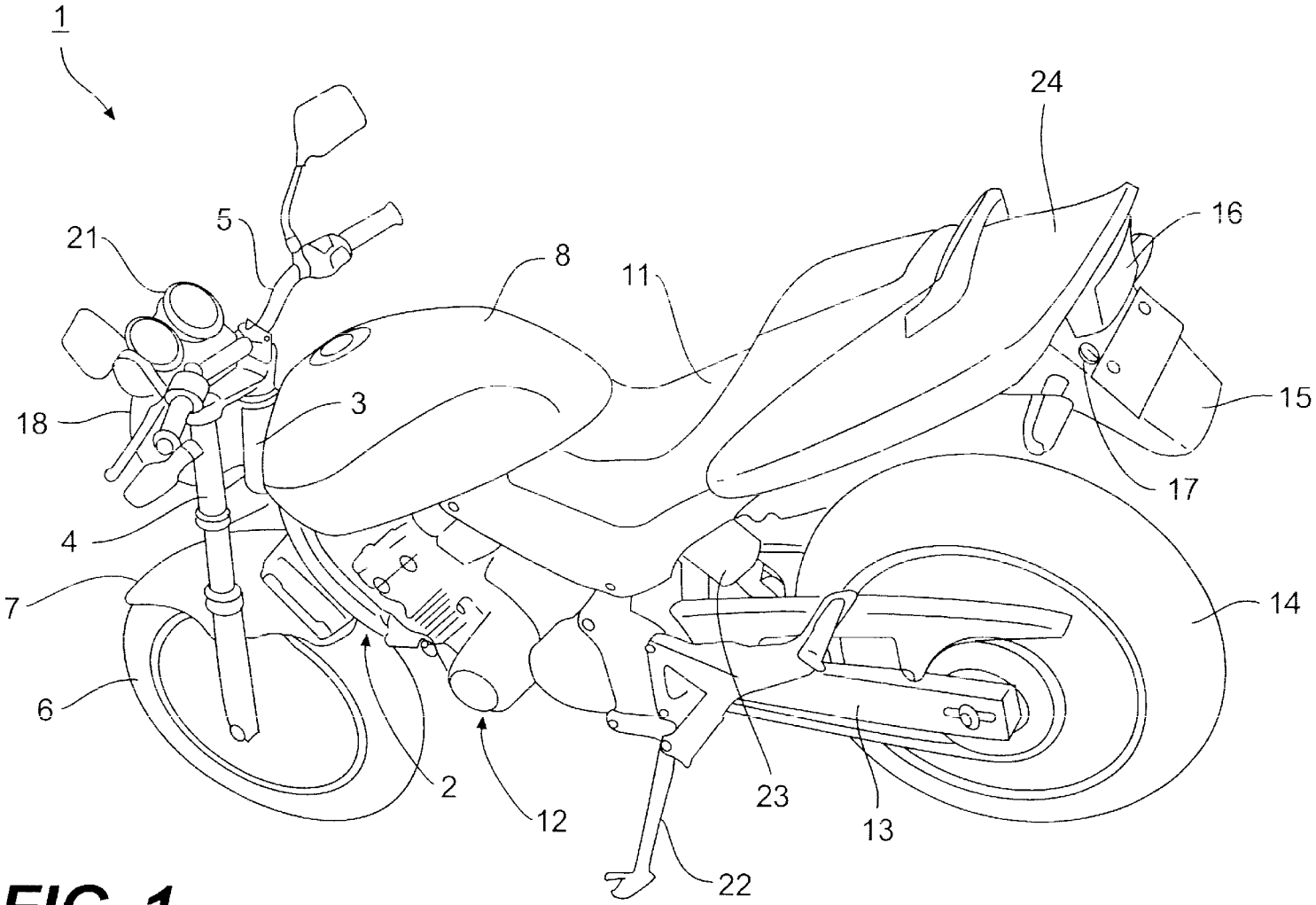
FIG. 1 is a perspective view of a motorcycle to which the attachment structure for a key cylinder in accordance with the present invention is applied.

Embodiments of the present invention will now be described in detail with reference to the attached drawings. FIG. 1 is a perspective view of a motorcycle to which an attachment structure for a key cylinder in accordance with the present invention is applied. The motorcycle 1 includes a body frame 2, a head pipe 3 provided in front of a body frame 2, a front fork 4 attached rotatably to the head pipe 3, a handlebar 5 attached on the front fork 4, a front wheel 6 attached rotatably under the front fork 4, and a front fender 7 which covers the front wheel 6.

Furthermore, the motorcycle 1 includes a fuel tank 8 attached to the body frame 2 located behind the head pipe 3, a seat 11 located behind the fuel tank 8, a power unit 12 including an engine and a transmission located under the fuel tank 8 and seat 11, a swing arm 13 attached swingably to the body frame 2 behind the power unit 12, a rear wheel 14 attached rotatable to the rear end of the swing arm 13 which is driven by the power unit 12, a rear fender 15 provided above the rear wheel 14, and a stop tail lamp 16 attached to the rear of the rear fender 15.

Furthermore, the motorcycle 1 is provided with a key cylinder 17 for operating a lock release device (not shown in the drawing) for detaching the seat 11. The key cylinder is provided under the stop tail lamp 16 on the rear fender 15.

Reference numeral 18 denotes a head lamp, 21 denotes a combination meter, 22 denotes a side stand, 23 denotes a rear suspension, and 24 denotes a rear cowl.

Figure 2:
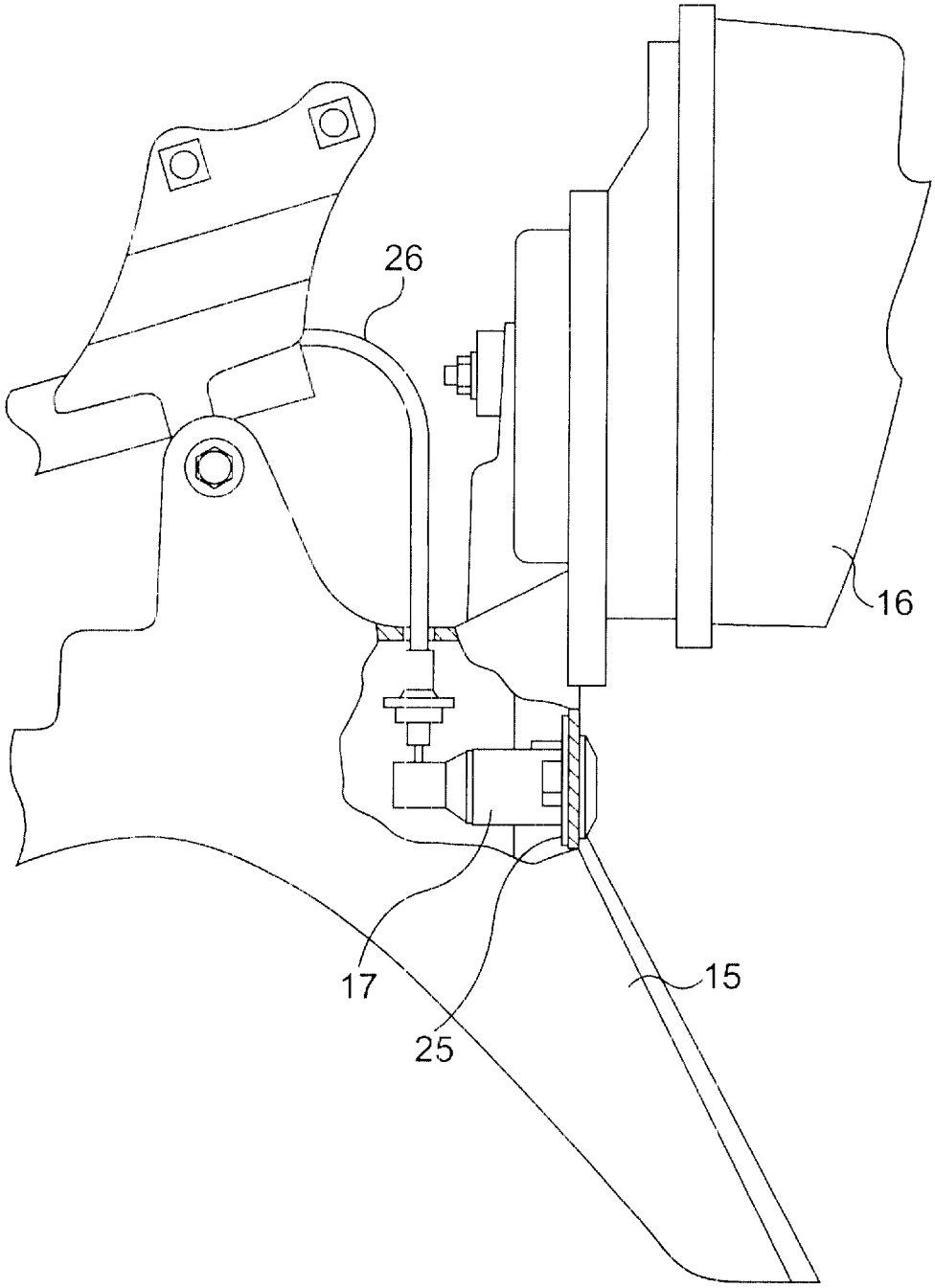
FIG. 2 is a side view of the rear of a motorcycle for illustrating the attachment structure for a key cylinder in accordance with the present invention.

FIG. 2 is a side view of the rear of the motorcycle for describing the attachment structure for a key cylinder of the present invention. FIG. 2 partially shows the cross section of the rear fender 15 in which the rear cowl 24 (refer to FIG. 1) is detached.

In this drawing, the key cylinder 17 is fixed to the rear fender 15 with a leaf spring 25. A lock release cable 26 connects the key cylinder 17 and the lock release device (not shown in the drawing).

Figure 3:
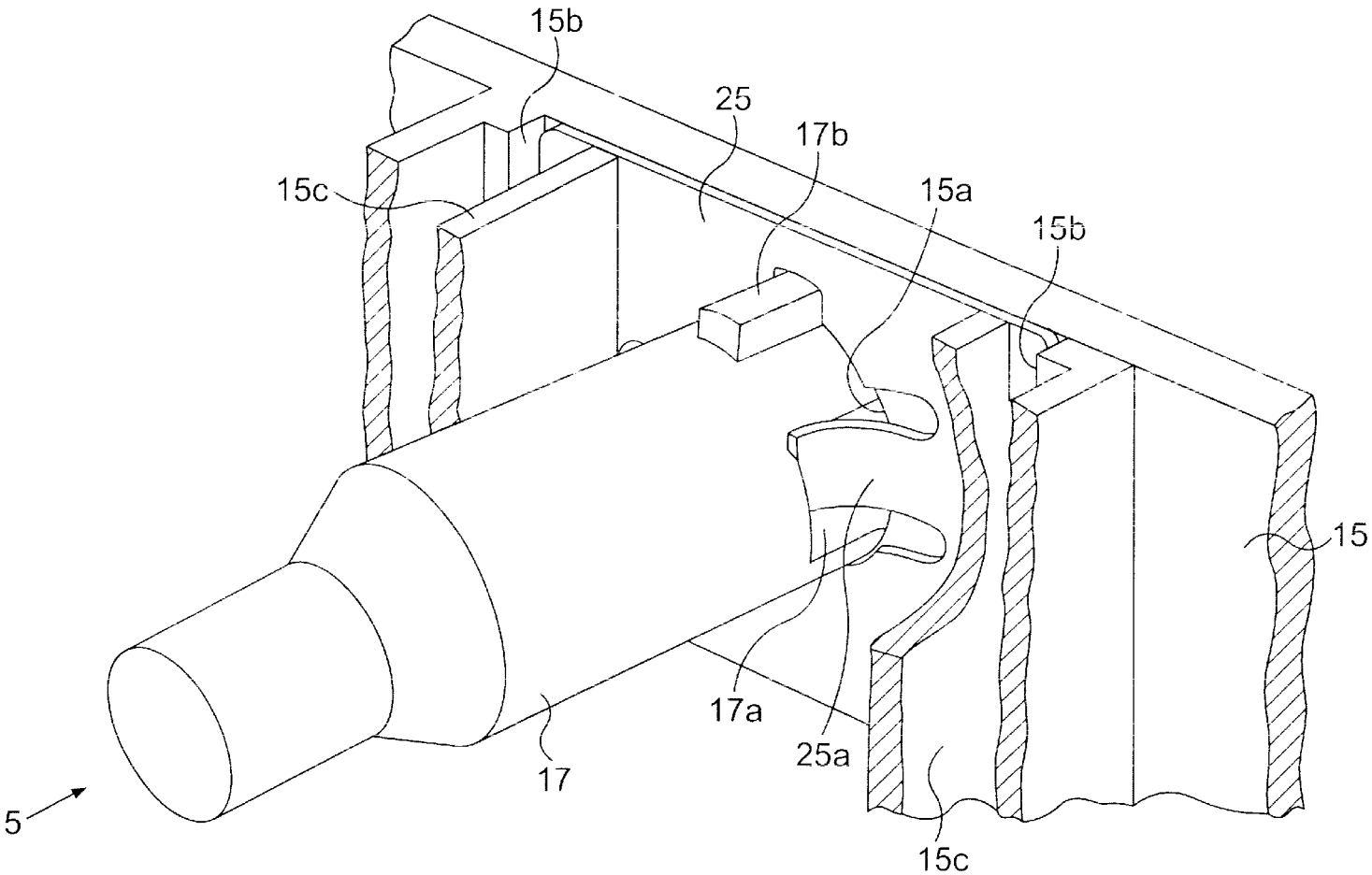
FIG. 3 is a perspective view for illustrating the attachment structure in accordance with the present invention.

FIG. 3 is a perspective view for illustrating the attachment structure for a key cylinder in accordance with the present invention. In this drawing, an attachment hole 15*a* is provided to attach the key cylinder 17 to the rear fender 15. The leaf spring 25 has spring tabs 25*a*, 25*a* (the back spring tab does not appear in the drawing) previously located inside the attachment hole 15*a*. The key cylinder 17 has rectangular grooves 17*a*, 17*a* (the back rectangular groove 17*a* does not appear in the drawing) inserted into the attachment hole 15*a* from the outside to the inside of the rear fender 15 to thereby insert the spring tabs 25*a*, 25*a* into the rectangular grooves 17*a*, 17*a* with the aid of elastic force caused when the spring tabs 25*a*, 25*a* are bent in the insertion direction of the key cylinder 17. Numerals 15*b*, 15*b* denote steps for restricting the rotation of the leaf spring 25, 15*c*, 15*c* denote wear plates for restricting the movement of the leaf spring 25 in the insertion direction of the key cylinder 17, and 17*b* denotes a convex portion for preventing the rotation of the key cylinder 17.

Figure 4A:
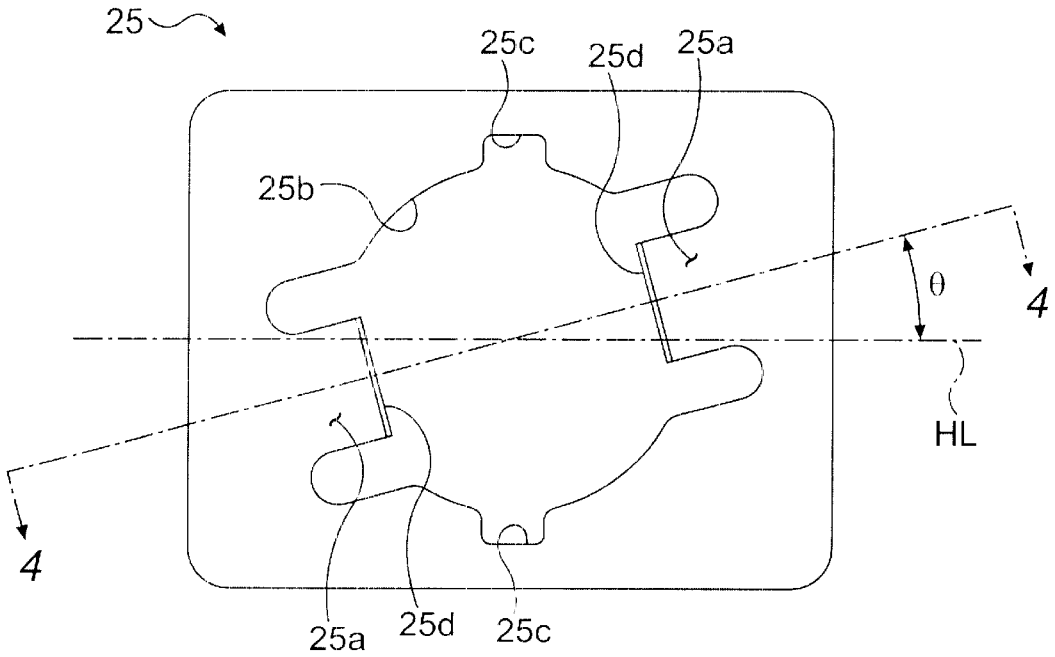
FIGS. 4(*a*) and 4(*b*) are a diagrams for illustrating a leaf spring in accordance with he present invention.
Figure 4B:
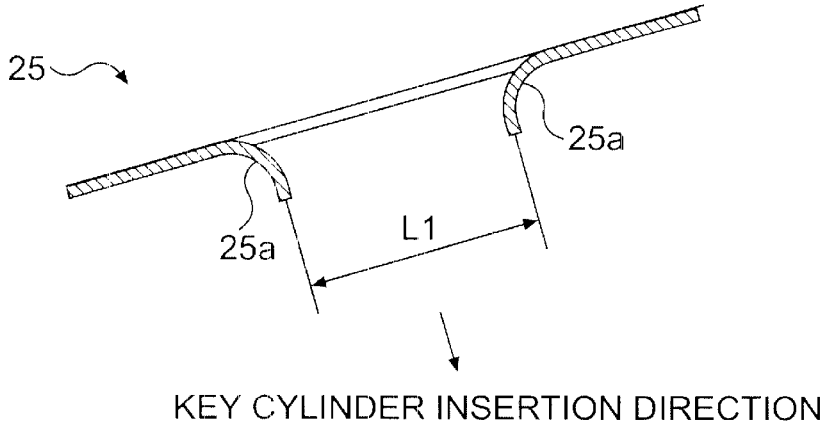

FIGS. 4(*a*) and 4(*b*) are diagrams for illustrating the leaf spring in accordance with the present invention, FIG. 4(*a*) is a front view and FIG. 4(*b*) is a cross sectional view along the line 4—4 in FIG. 4(*a*).

In FIG. 4(*a*), the leaf spring 25 includes the spring tabs 25*a*, 25*a*, a hole 25*b* for insertion of the key cylinder 17 (refer to FIG. 3), and notches 25*c*, 25*c* for receiving the convex portion 17*b* of the key cylinder 17. 25*d*, 25*d* denote top ends of the spring tabs 25*a*, 25*a*. Furthermore, the spring tabs 25*a*, 25*a* are inclined an angle θ with respect to the horizontal line HL.

In FIG. 4(*b*), the spring tab 25*a* is deformed elastically in the insertion direction of the key cylinder 17 and shaped in the form of a circular arc. Furthermore, the shortest distance between the two spring tabs 25*a*, 25*a* is represented by L1.

Figure 5:
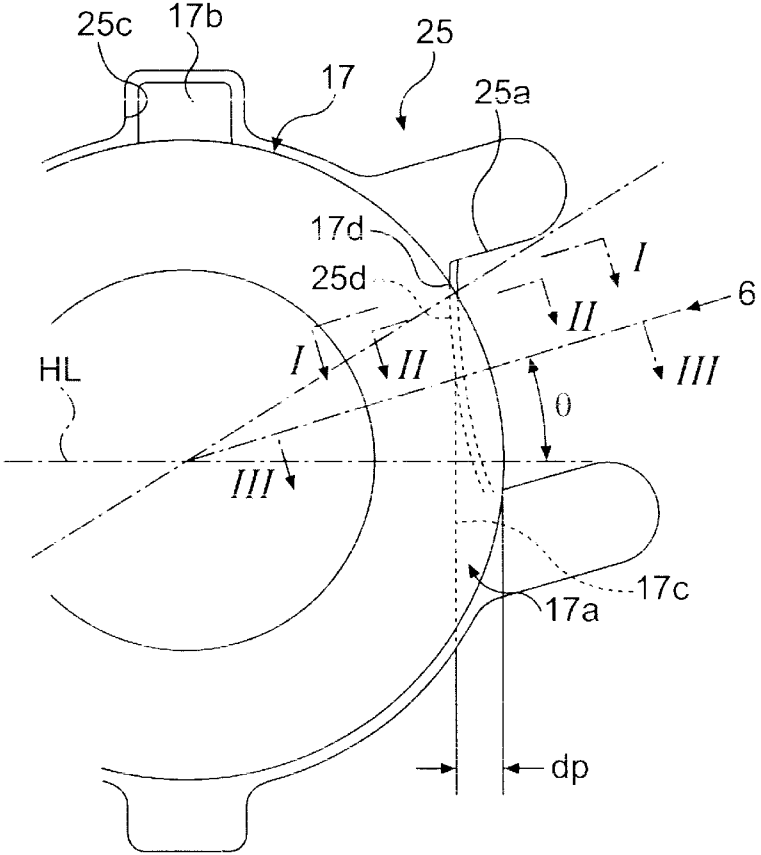
FIG. 5 is a diagram viewed along an arrow 5 in FIG. 3.

FIG. 5 is a diagram viewed along an arrow 5 in FIG. 3 for describing the positional relationship between the bottom face 17*c* of the rectangular groove 17*a* of the key cylinder 17 and the top end 25*d* of the spring tab 25*a* of the leaf spring 25.

The bottom face 17*c* of the rectangular groove 17*a* is orthogonal to the horizontal line HL. The top end 25*d* of the spring tab 25*a* is located with an inclination angle θ with respect to the bottom face 17*c* of the rectangular groove 17*a* when the notch 25*c* of the spring tab 25*a* is fitted to the position of the convex portion 17*b* of the key cylinder 17 before the spring tab 25*a* is bent.

In the drawing, the top end 25*d* is partially in contact with the edge 17*d* of the end of the rectangular groove 17*a* (the edge 17*d* is a line of intersection of the bottom face 17*c* and the peripheral surface of the key cylinder 17, and is a straight line perpendicular to the paper plane. Herein, the edge 17*d* is shown with a mark •).

Figure 6:
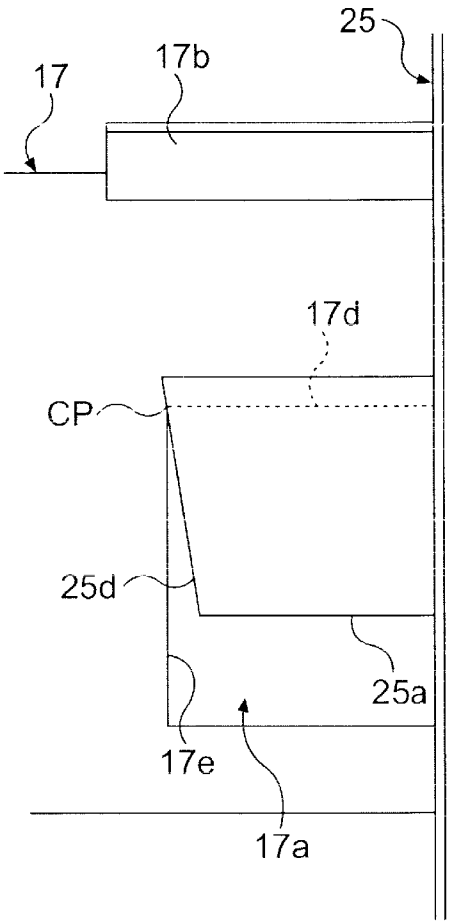
FIG. 6 is a diagram viewed along an arrow 6 in FIG. 5.

FIG. 6 is a diagram viewed along an arrow 6 in FIG. 5 for describing the positional relation between the back wall 17*e* of the rectangular groove 17*a* and the top end 25*d* of the spring tab 25*a*.

Figure 7A:
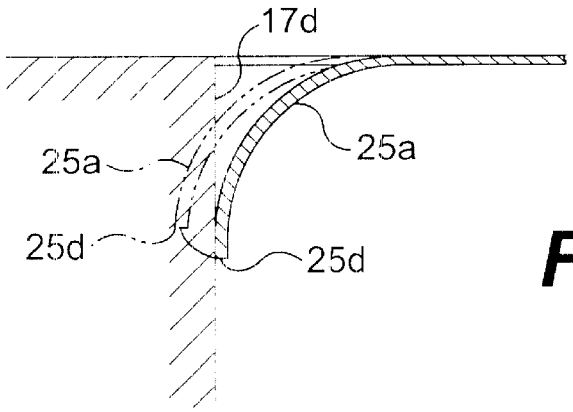
FIGS. 7(*a*)–7(*c*) are a cross sectional views for illustrating the bending of the leaf spring in accordance with the present invention.
Figure 7B:
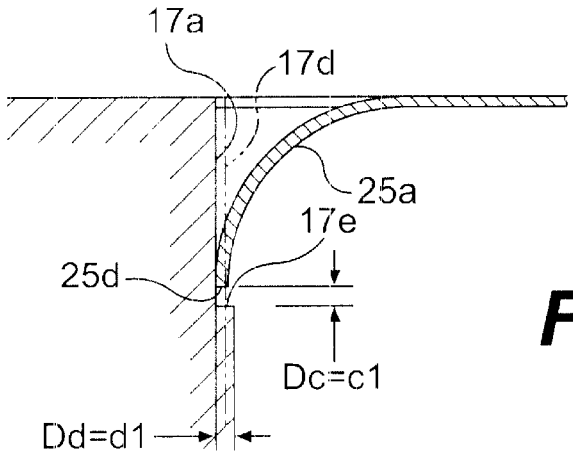
Figure 7C:
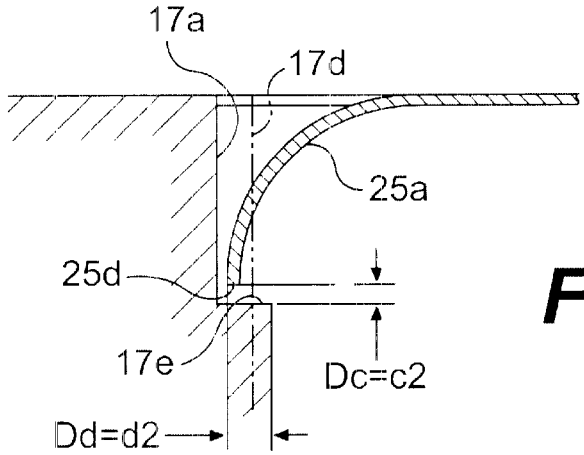

The top end 25*d* of the spring tab 25*a* is located inclined with respect to the back wall 17*e* due to bending of the spring tab 25*a* as described for FIG. 7. The top end 25*d* of the spring tab 25*a* passes the cross point CP of the edge 17*d* and the back wall 17*e* or passes the point which is located on the opposite side to the insertion direction of the key cylinder 17 and located near the cross point CP.

FIGS. 7(*a*) to 7(*c*) show cross sections for illustrating the bending of the leaf spring in accordance with the present invention. FIG. 7(*a*) is a cross sectional view along the line I—I in FIG. 5 for showing the edge 17*d* of the rectangular groove 17*a*. FIG. 7(*b*) is a cross sectional view along the line II—II in FIG. 5 for showing the portion slightly deviated toward the center side of the rectangular groove 17*a* from the edge 17*d*. FIG. 7(*c*) is a cross sectional view along the line III—III in FIG. 5 for showing the portion further deviated toward the center side of the rectangular groove 17*a* from the edge 17*d* than in FIG. 7(*b*).

In FIG. 7(*a*), the spring tab 25*a* is bent from the initial position shown with an imaginary line. The top end 25*d* of the spring tab 25*a* is partially brought into contact with the edge 17*d*.

In FIG. 7(*b*), the top end 25*d* of the spring tab 25*a* enters slightly into the rectangular groove 17*a*, and a gap Dc between the back wall 17*e* of the rectangular groove 17*a* and the top end 25*d* of the spring tab 25*a* is small. The depth Dd which is a penetration depth of the top end 25*d* into the rectangular groove 17*a* is represented by d1, and the gap is represented by c1.

In FIG. 7(*c*), the top end 25*d* of the spring tab 25*a* penetrates deeply into the rectangular groove 17*a*, and the gap between the back wall 17*e* of the rectangular groove 17*a* and the top end 25*d* of the spring tab 25*a* is larger than in FIG. 7(*b*). The depth Dd of the top end 25*d* is represented by d2 and the gap is represented by c2 in FIG. 7(*c*).

In FIG. 7(*a*) the depth Dd=0 and the gap Dc=0. Therefore, 0<d1<d2, and 0<c1<c2.

The positional relationship between the back wall 17*e* and the top end 25*d* in FIG. 6 is due to the change of the gap Dc described hereinabove.

Figure 8:
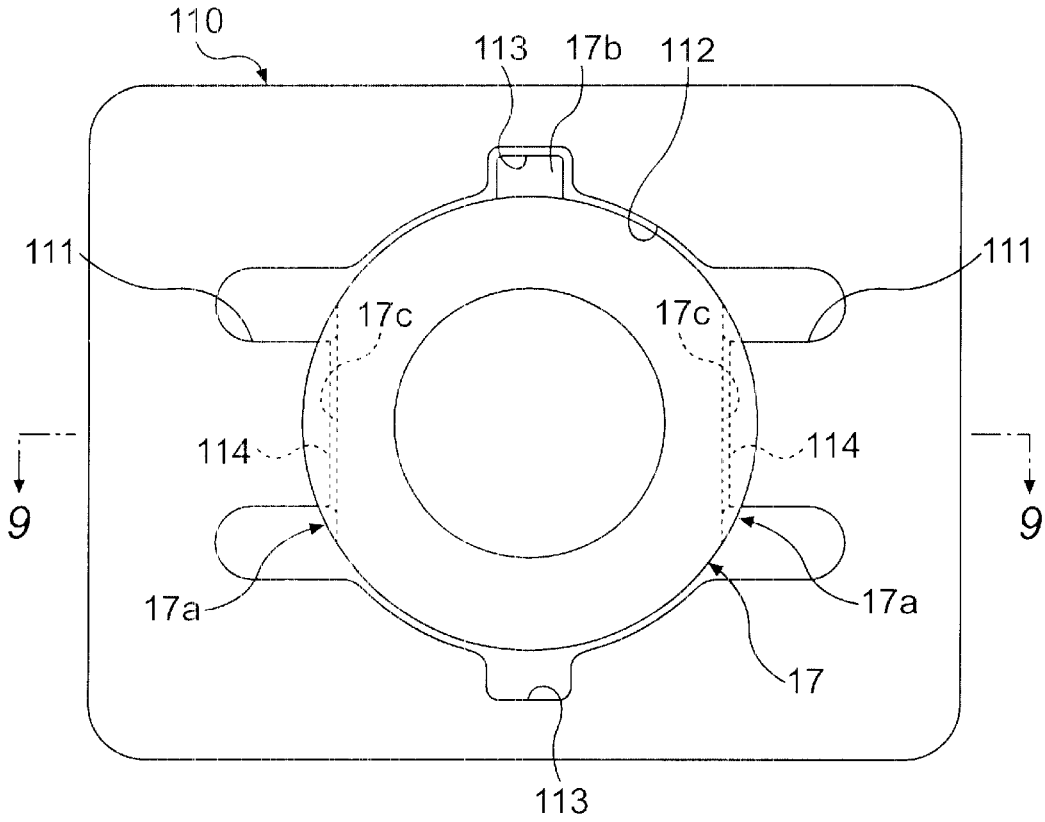
FIG. 8 is a front view for illustrating a comparative example of a leaf spring.

FIG. 8 is a front view for illustrating a comparative example of a leaf spring. The key cylinder itself is the same as that shown in the present embodiment of the present invention.

A leaf spring 110 includes spring tabs 111, 111, a hole 112 where the key cylinder 17 is inserted, and notches 113, 113 where a convex portion 17*b* of the key cylinder 17 is inserted. Numerals 114, 114 denote the top ends of the spring tabs 111, 111. The spring tabs 111, 111 are brought into contact with the bottom face 17*c* of the rectangular groove 17*a* of the key cylinder 17 in parallel.

Figure 9:
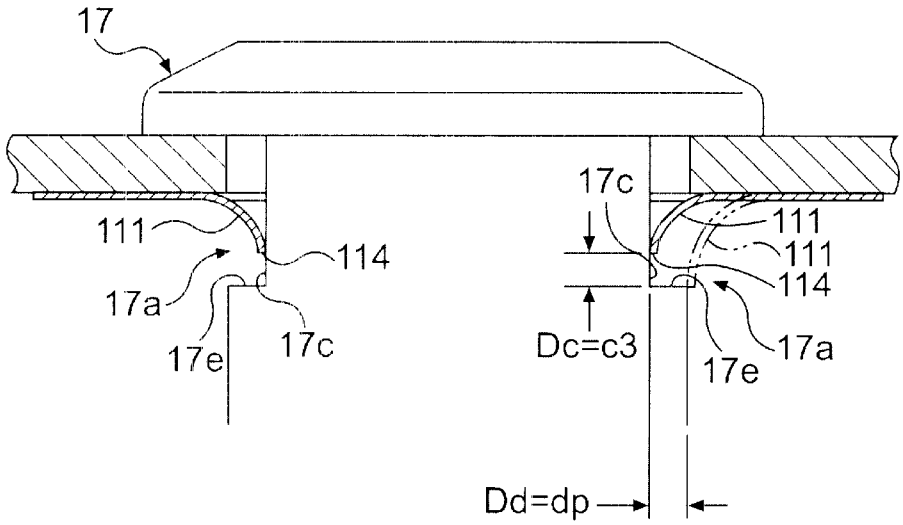
FIG. 9 is a cross sectional view along the line 9—9 in FIG. 8.
Figure 10B:
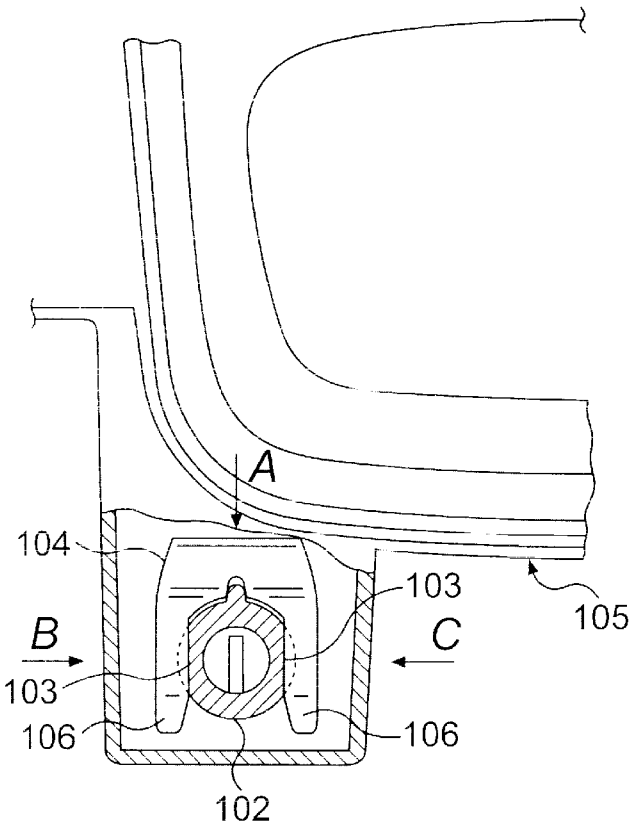
FIG. 10(b) BACKGROUND ART
FIGS. 10(*a*) and 10(*b*) are diagrams for illustrating the conventional attachment structure for a key cylinder.
Figure 10A:
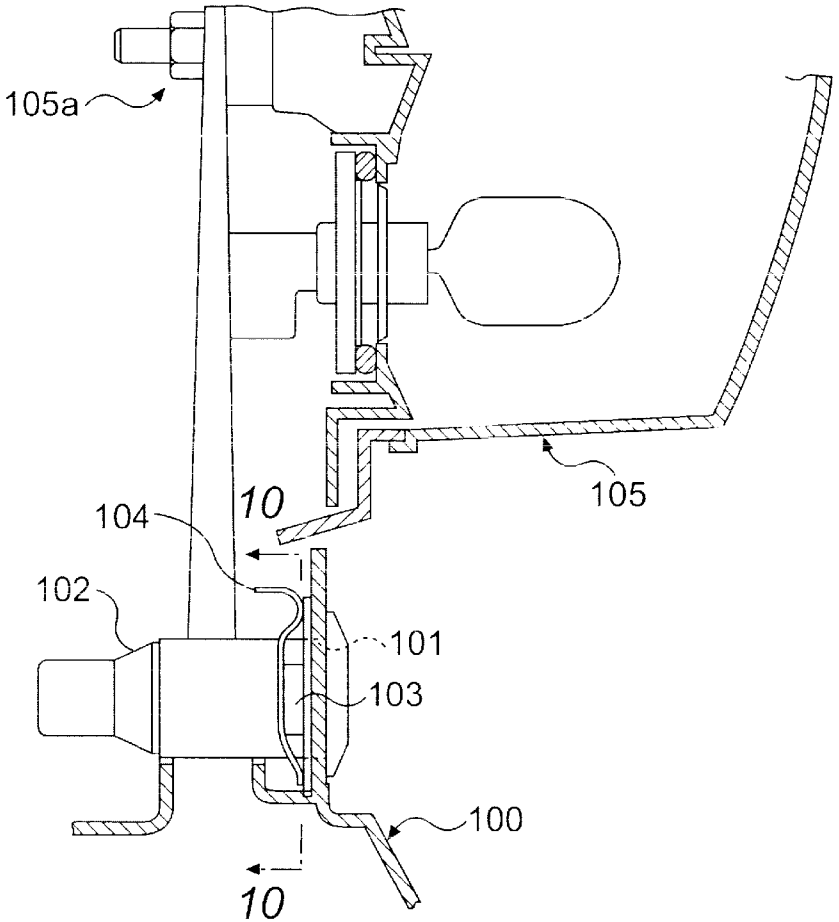
FIG. 10(a) BACKGROUND ART

FIG. 9 is a cross sectional view along the line 9—9 in FIG. 8. The depth Dd; namely, penetration of the top end 114 into the rectangular groove 17*a* is dP (refer also to FIG. 5). The relation between the depths d1 and d2 shown in FIGS. 7(*a*) and 7(*b*) and the depth dp is represented by d1<d2<dp.

The gap Dc between the back wall 17*e* of the rectangular groove 17*a* and the top end 114 is denoted by c3. Since the gap Dc increases with increasing the depth Dc, c1<c2<c3.

Therefore, the gap c3 in the comparative example, in which the spring tab 111 is in contact with the bottom face 17*c* of the rectangular groove 17*a* of the key cylinder 17, is larger than the gaps c1 and c2 in the present embodiment of the present invention. In other words, the vibration in the insertion direction of the key cylinder 17 is larger when the key cylinder 17 is attached.

Based on the description with reference to FIG. 7 to FIG. 9, it is understood that the depth Dd of penetration of the top end 25*d* of the spring tab 25*a* is reduced by means of the method in which the top end 25*d* of the spring tab 25*a* is partially in contact with the edge 17*d*. As a result, the gap Dc between the back wall 17*e* of the rectangular groove 17*a* and the top end 25*d* can be reduced.

Therefore, the vibration in the insertion direction of the key cylinder 17 is reduced when the key cylinder 17 (refer to FIG. 6) is attached. For example, in a case where an attachment structure, in which a key cylinder and a fork-shaped leaf spring are used, is changed to an attachment structure of the present invention, the present invention can be applied simply by replacing the leaf spring without changing the configuration of the key cylinder; namely, the position or angle of the rectangular groove. Therefore, the expensive cost required to modify the configuration of the existing key cylinder or fabricate a new key cylinder can be avoided.

Even if the leaf spring 25 (refer to FIG. 6) is permanently set with time, the vibration in the insertion direction does not increase, because the position of the top end 25*d* of the spring tab 25*a* in the insertion direction of the key cylinder is not changed. As the result, the vibration in the insertion direction of the key cylinder 17 can be reduced.

The attachment structure of the present invention can be applied not only to motorcycles but also to other various products which use a key cylinder. For example, the present invention can be used in vehicles such as three-wheeled vehicles, four-wheeled vehicles, electric vehicles, industrial machines, appliances, furniture, sanitary equipment and toys.

In summary, the attachment structure for a key cylinder is provided with the leaf spring including a plate having a hole into which the key cylinder is inserted, a notch into which the convex portion is inserted, and spring tabs which can be bent elastically in the insertion direction of the key cylinder formed thereon. The key cylinder can be attached easily to the body simply by inserting the key cylinder into the hole of the attachment unit. The leaf spring is provided previously to the hole of the attachment unit. In the case where other parts are attached around the hole of the attachment unit, the key cylinder can be attached without interference, and freedom of assembly order is increased.

The top end of the spring tab is inclined with respect to the bottom face of the rectangular groove before bending so that the top end of the spring tab is partially in contact with the back wall edge after bending. The insertion depth of the top end of the, spring tab can be reduced. When the key cylinder is inserted into the hole of the leaf spring, the positional change of the top end from the position before insertion of the top end of the spring tab into the rectangular groove to the position after insertion is reduced.

Accordingly, the vibration of the key cylinder in the insertion direction of the key cylinder can be reduced simply by replacing the leaf spring without modifying the configuration of the key cylinder.

The position of the top end of the spring tab in the insertion direction of the key cylinder is not changed even if the leaf spring is permanently set with time. The vibration in the insertion direction does not increase and the vibration in the insertion direction of the key cylinder is reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An attachment structure for a key cylinder, the key cylinder provided with a convex portion on a peripheral surface thereof for preventing rotation, and two rectangular grooves for fixing the key cylinder in a hole of an attachment unit, comprising:

a leaf spring for hooking on the rectangular groove of the key cylinder to prevent the key cylinder from coming out of the hole of the attachment unit, said leaf spring including:

a plate having a hole for receiving the key cylinder therethrough;

a notch for receiving the convex portion of the key cylinder;

two spring tabs elastically bendable in an insertion direction of the key cylinder, wherein a top end of each of said spring tabs is inclined with respect to a bottom of the rectangular grooves of the key cylinder before bending, so that the top end is partially brought into contact with a back wall edge of the rectangular grooves of the key cylinder after bending; and wherein a line connecting a center of each of said two spring tabs is inclined at an angle with respect to a horizontal line.

2. A key cylinder assembly, comprising:

an attachment unit having a hole formed therethrough;

a key cylinder inserted through the hole of the attachment unit, said key cylinder having a convex portion formed on a peripheral surface thereof for preventing rotation, and two rectangular grooves for fixing the key cylinder within the hole;

a leaf spring for hooking on the rectangular groove of the key cylinder to prevent the key cylinder from coming out of the hole of the attachment unit, said leaf spring including:

a plate having a hole for receiving the key cylinder therethrough;

a notch for receiving the convex portion of the key cylinder;

two spring tabs elastically bendable in an insertion direction of the key cylinder, wherein a top end of each of said spring tabs is inclined with respect to a bottom of the rectangular grooves of the key cylinder before bending, so that the top end is partially brought into contact with a back wall edge of the rectangular grooves of the key cylinder after bending; and wherein a line connecting a center of each of said two spring tabs is inclined at an angle with respect to a horizontal line.

3. A key cylinder, comprising:

a plate having a hole for receiving the key cylinder therethrough;

a notch for receiving a convex portion of the key cylinder;

two spring tabs elastically bendable in an insertion direction of the key cylinder upon insertion of the key cylinder into the hole of the attachment unit, wherein a top end of each of said spring tabs is inclined with respect to a bottom of rectangular grooves of the key cylinder before bending, so that the top end is partially brought into contact with a back wall edge of the rectangular grooves of the key cylinder after bending; and wherein a line connecting a center of each of said two spring tabs is inclined at an angle with respect to a horizontal line.

* * * * *